United States Patent [19]

Dowzall et al.

[11] Patent Number: 4,539,759

[45] Date of Patent: Sep. 10, 1985

[54] APPARATUS FOR USE WITH DRY TRANSFER LETTERING SHEETS

[75] Inventors: Martin E. Dowzall, Wycoff; Vazgen J. Houssian, Union City, both of N.J.

[73] Assignee: Esselte Pendaflex Corporation, Garden City, N.Y.

[21] Appl. No.: 443,148

[22] Filed: Nov. 19, 1982

[30] Foreign Application Priority Data

Nov. 20, 1981 [GB] United Kingdom ..... 8135002

[51] Int. Cl.[3] ..... B41B 1/00; B43L 13/24

[52] U.S. Cl. ..... 33/184.5; 33/430; 33/447

[58] Field of Search ..... 33/1 AA, 184.5, 430, 33/436, 438, 447

[56] References Cited

U.S. PATENT DOCUMENTS

| | | | |
|---|---|---|---|
| 2,822,736 | 2/1958 | Padgett | 33/184.5 |
| 3,165,834 | 1/1965 | Benton | 33/184.5 |
| 3,239,940 | 3/1966 | Berkowitz | 33/184.5 |
| 3,762,055 | 10/1973 | Citrin | 33/447 |
| 4,232,452 | 11/1980 | Dowzall et al. | 33/430 |
| 4,342,155 | 8/1982 | Waldron | 33/184.5 |
| 4,364,184 | 12/1982 | Dowzall | 33/447 |

FOREIGN PATENT DOCUMENTS

| | | | |
|---|---|---|---|
| 59774 | 6/1913 | Austria | 33/447 |
| 1954536 | 6/1970 | Fed. Rep. of Germany | 33/438 |
| 2235805 | 1/1975 | France | 33/1 AA |

*Primary Examiner*—Richard R. Stearns

*Attorney, Agent, or Firm*—Darby & Darby

[57] ABSTRACT

Apparatus is described which may be substituted for the vertical rule on a conventional drafting machine arrangement having a pair of rules set at right angles to one another. The apparatus includes a clamp for a transfer sheet which is movable in steps. Used with a dry transfer sheet with lines of letters on it, the interline spacing of which is an integral multiple of the stepped movement spacing of the apparatus, and fitted to a conventional drafting machine, the apparatus assists in applying accurate baseline legends to drawings using dry transfer rather than hand lettering.

4 Claims, 3 Drawing Figures

APPARATUS FOR USE WITH DRY TRANSFER LETTERING SHEETS

This invention relates to apparatus for use in connection with dry transfer lettering sheets, particularly to apparatus for use in connection with applying indicia to technical drawings of large size.

Technical drawings are conventionally made by draughtsmen on drawing boards of size e.g. 1.5 by 1.0 meters with landscape format. In order to produce technical drawings with straight lines, such boards are conventionally provided with a drafting machine, which includes a pair of rulers set at right angles to one another in a holder and capable of being moved as a unit vertically up and down the board and horizontally from side to side. It is often very convenient to be able to move such a pair of rulers vertically without moving them horizontally or vice versa and for this reason, the pair of rulers are often mounted on a member which is slidable vertically in a slide, which slide is itself slidable horizontally. Brakes are provided to prevent either one of these sliding movements from occurring. The assembly of slides, holders and rulers is known as a drafting machine. British Patent Specification Nos. 1,204,850, 1,293,084 and 1,364,662 disclose such machines.

It is often necessary to dimension technical drawings or to label parts on them. This is normally done by hand, but hand lettering and numerals naturally vary in style from draughtsman to draughtsman and are generally of a rather indistinctive thin line nature. Additionally, the lettering skills of some draughtsmen are unsatisfactory to produce a good looking final drawing. For many years an alternative approach has been possible of applying lettering, reference numerals and the like using dry transfer materials.

Dry transfer lettering sheets are wide available in commerce under a variety of trade names, particularly those sold under the Trade Mark LETRASET INSTANT LETTERING and they are available in a wide variety of type styles and type sizes. They are described e.g. in U.S. Pat. Nos. 3,212,913 and 3,131,106, the disclosures of which are expressly incorporated herein by reference.

According to the present invention there is provided apparatus for use in conjunction with a dry transfer lettering sheet and a drawing board, including a drafting machine comprising a device for mounting a drawing accessory such as a scale, the device being capable of horizontal motion across the drawing board and vertical motion up and down the drawing board, and means being provided to brake the vertical motion of the device, the apparatus comprising a base member adapted to be firmly attached to the mounting device on the drafting machine and a transfer sheet supporting member slidably mounted relative to the base member in such fashion that when the base member is mounted on the mounting device, the transfer sheet supporting member may be moved vertically up and down the drawing board, and means for dividing that vertical motion into a number of equally spaced steps.

Such apparatus may be mounted on a standard drafting machine in place of e.g. one of the normal rulers, usually the vertical ruler, and for that purpose it may include a mounting plate, chuck plate, key or other fitment adapted to mate with the mounting device on the drafting machine.

This enables the device of the invention to be exchanged for the vertical rule or scale quickly, efficiently and without the use of any tools, and to be as quickly and easily removed when no longer needed for immediate use, or when the vertical rule is needed again.

With the device mounted on a drafting machine, a sheet of dry transfer material may be placed in the transfer sheet supporting member. This member preferably includes pin register means enabling the sheet to be mounted with its lines of letters accurately horizontal. By ensuring that the lines of letters on the dry transfer sheet are spaced vertically by integral multiples of the step size of the equal step spacing which the mounting means executes relative to the base, accurate horizontal alignment of a set of letters may be ensured and accordingly high quality, accurately aligned inscriptions may be placed on drawings while they are still on the drawing board. During the use of the apparatus in this way it is, of course, necessary to apply the vertical brake of the drafting machine to the mounting means, vertical movement of the transfer sheet being effected simply by stepping the transfer sheet supporting member one or more steps vertically up or down. The lateral spacing is, of course, obtained by shifting the entire assembly horizontally using the normal horizontal motion available on the drafting machine.

Sheets of dry transfer material with the letters spaced by integral multiples of a given dimension are now available in commerce under the Trade Mark SIGNTYPE and are, of course, straightforward to produce by normal dry transfer sheet manufacturing methods. SIGNTYPE sheets are commercially available for use in connection with a signmaking process described generally in British Patent Specification No. 2,005,596A. Means for mounting such sheets including a stepped vertical spacing system are described in British Patent Specification Nos. 2007154A and 2013573A.

The invention is illustrated by way of example with reference to the accompanying drawings, in which.

Figure 1:
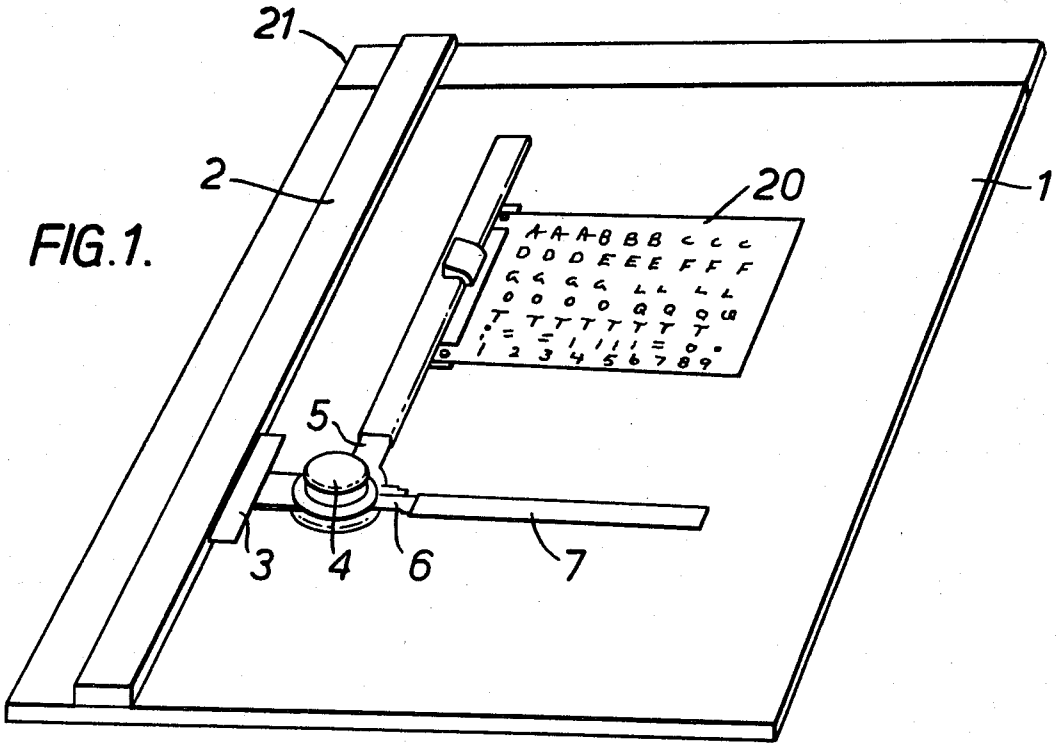
FIG. 1 is a perspective view of a drawing board showing apparatus according to the invention in the operative position.

Referring to the drawings and initially to FIG. 1, there is shown a drawing board 1 having mounted thereon a conventional drafting machine incorporating a bar 2 which extends vertically from top to bottom of the board and which can be moved from side to side on a horizontal track 21. Mounted slidably along bar 2 is a carriage 3 which bears a protractor head 4 from which extend two mounting chucks 5 and 6; a horizontal scale 7 is shown engaged on chuck 6. Chuck 5 in contrast bears the apparatus according to the present invention.

Referring to that apparatus, it consists basically of a base plate 8 having a chuck plate 9 attached thereto. Chuck plate 9 is configured to engage in an appropriate receiver on chuck 5 by a firm clipping action, no tools being needed to effect this, and when so engaged a track 10 fixed to plate 8 may be adjusted to extend exactly vertically up the drawing board, i.e., parallel to bar 2. Initial adjustment is effected in conventional fashion by loosening the screws which mount chuck plate 9 on plate 8, chuck plate 9 having one circular and one elongate aperture allowing plate 8 to be swivelled slightly to set it and track 10 exactly vertical.

Located in track 10 is a carriage 12. This runs on a conventional ball bearing linear slide mechanism having an inner member 11 which acts as a ball bearing retainer. The arrangement may be, for example, of the general type described in U.S. Pat. Nos. 3,778,120 and 3,205,025, the disclosures of which are expressly incorporated herein by reference.

Attached to the underside of carriage 12 is a further mounting plate 13 which extends laterally of track 10 and bears on its projecting end a transfer sheet magnetic clip consisting of a hinged flap 14 which cooperates with base member 13, and including a pair of register pins 22. Mounted fixedly relative to carriage 12 is an operation handle 15 which can be grasped by a user in order to slide carriage 12 up and down track 10.

The motion of carriage 12 up and down the track 10 is a stepped motion by virtue of the engagement of a ball 16 in one of a plurality of evenly spaced detents 17 formed on the edge of track 10. Ball 16 is held captive in a spring steel plate 18 attached to carriage 12.

The working parts are covered by a plastics cover 19 which is a clip fit over track 10.

Figures 2, 3:
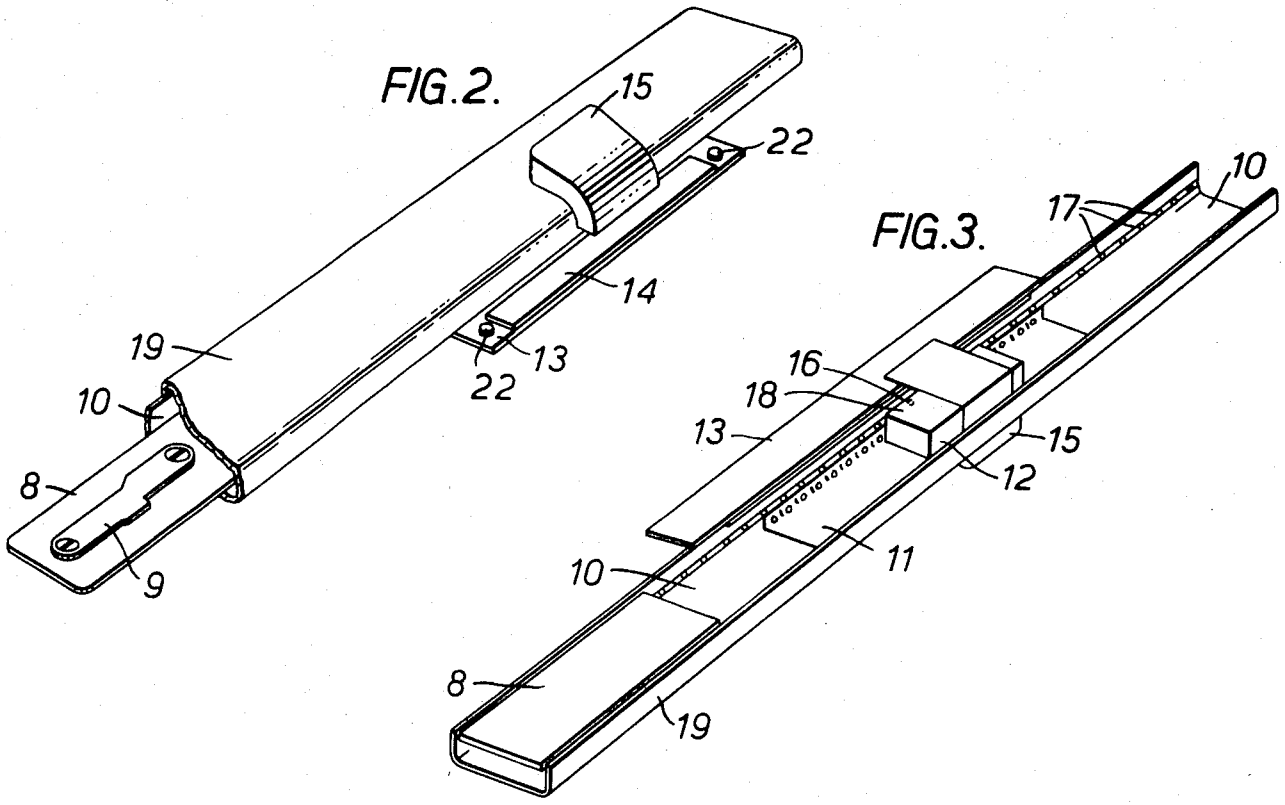
FIG. 2 is a view on an enlarged scale of the apparatus according to the invention.
FIG. 3 is a view on a similarly enlarged scale showing the underside of apparatus according to the invention.

In use the device shown in FIGS. 2 and 3 is simply substituted for the normal vertical rule on chuck 5 and a sheet of dry transfer material 20 registered on pins 22 and is clamped between base member 13 and flap 14.

The drafting machine arm is then moved roughly to the desired position on the drawing board with the transfer sheet 20 overlaying the artwork or drawing on to which it is desired to transfer letters, e.g. to label parts. One line of the dry transfer material is then brought into the desired vertical position, and the movmement of carriage 3 along bar 2 is then prevented by applying the conventional vertical brake which normally forms part of such drafting machines. Thereafter, the transfer sheet 20 can be moved laterally by sliding the entire assembly on bar 21 and vertically by moving the sheet up and down using handle 15, i.e. by indexing carriage 12 along track 10.

Since the spacing between the lines of letters and figures on transfer sheet 20 is an integral multiple of the step spacing between equally spaced detents 17 on track 10, accurate horizontal baseline alignment of letters sequentially transferred from different lines of the transfer sheet 20 on to the drawings or artwork is easily achieved. Labelling of different areas of the drawing or artwork merely requires unlocking the vertical brake of the drafting machine, moving the assembly with the sheet 20 to the desired new position, reapplying the vertical brake, and transferring further letters. At the end of labelling, the device may simply be unclipped and the vertical rule replaced on the drafting machine.

We claim:

1. Apparatus for use in conjunction with a dry transfer lettering sheet and a drawing board having a height in a vertical direction and including a drafting machine comprising a device for mounting a drawing accessory such as a scale, the device being capable of horizontal motion across the drawing board and a first motion in said vertical direction up and down the vertical height of said drawing board, and means being provided to brake the vertical motion of the device, the apparatus comprising a base member means for firm attachment to the mounting device on the drafting machine and a transfer sheet supporting means slidably mounted for a second motion thereof in said vertical direction relative to the base member means, when the base member means is mounted on the mounting device, and means for dividing said second vertical motion into a number of equally spaced steps, said dividing means comprising a vertically oriented linear track having a plurality of evenly spaced detents therein, at least one ball bearing, ball bearing retaining means for holding said ball bearing, carriage means affixed to said ball bearing retaining means and said transfer sheet supporting means, and spring means for pressing said ball bearing into said detents.

2. Apparatus according to claim 1 and including a mounting fitment to mate with a mounting device on a drafting machine normally adapted to receive a scale.

3. Apparatus according to claim 2 wherein the mounting fitment is a chuck plate adapted to fit a chuck which forms part of the drafting machine.

4. Apparatus for labelling drawings in conjunction with dry transfer lettering sheets comprising:

a drawing board having a drawing supporting surface having a vertical height, a drafting machine mounted on the drawing board and including a mounting head, said mounting head being movable in a horizontal movement and in a first vertical movement with respect to said drawing supporting surface and means for braking the vertical movement of the mounting head, a mounting fitment on the mounting head, a base member releasably mounted on the mounting head, supporting means for holding said transfer sheet slidably mounted on the base member for a second vertical movement up and down the drawing supporting surface, means for biasing the position of the transfer sheet supporting means into one of a plurality of equally spaced positions within its range of said second vertical movement, said biasing means comprising a vertically oriented linear track having a plurality of evenly spaced detents therein, at least one ball bearing, ball bearing retaining means for holding said ball bearing, carriage means affixed to said ball bearing retaining means and said transfer sheet supporting means, and spring means for pressing said ball bearing into said detents, and said sheet of dry transfer material being held in the transfer sheet supporting member, the sheet having a plurality of lines of indicia thereon, each line extending horizontally across the drawing supporting surface, the vertical distance between adjacent lines being an integral multiple of the distance between two adjacent ones of the equally spaced positions.

* * * * *